US005312110A

United States Patent [19]

Youwanes

[11] Patent Number: 5,312,110

[45] Date of Patent: May 17, 1994

[54] BOARD GAME APPARATUS

[76] Inventor: Mark D. Youwanes, 3330 W. Greenway Rd., Apt 1088, Phoenix, Ariz. 85023

[21] Appl. No.: 950,180

[22] Filed: Sep. 24, 1992

[51] Int. Cl.[5] ..... A63F 3/02

[52] U.S. Cl. ..... 273/260; 273/237; 273/290

[58] Field of Search ..... 273/237, 238, 255, 258, 273/289, 290, 260, 261

[56] References Cited

U.S. PATENT DOCUMENTS

| | | | |
|---|---|---|---|
| 1,322,150 | 11/1919 | Thompson | 273/255 X |
| 3,568,357 | 3/1971 | Lebensfeld | 273/290 X |
| 4,083,564 | 4/1978 | Matsumoto | 273/255 X |
| 4,261,574 | 4/1981 | Rogers, Jr. | 273/255 X |
| 4,643,432 | 2/1987 | Berry et al. | 273/260 |
| 4,753,441 | 6/1988 | Braus et al. | 273/255 |
| 5,033,753 | 7/1991 | Yuen et al. | 273/261 |

FOREIGN PATENT DOCUMENTS

| | | | |
|---|---|---|---|
| 1518491 | 2/1968 | France | 273/255 |
| 2569124 | 2/1986 | France | 273/255 |

*Primary Examiner*—William Stoll
*Attorney, Agent, or Firm*—Leon Gilden

[57] ABSTRACT

A board game apparatus is arranged to include a game board having an equal predetermined number of rows and columns of squares, wherein opposing groups relative to simulated assemblies of tokens are positioned on opposed end portions of the game board to simulate soldiers, knights, a giant, and a captured king, wherein by elimination of opposing player tokens, a captured king is reclaimed by a moving player from an opposing player.

2 Claims, 5 Drawing Sheets

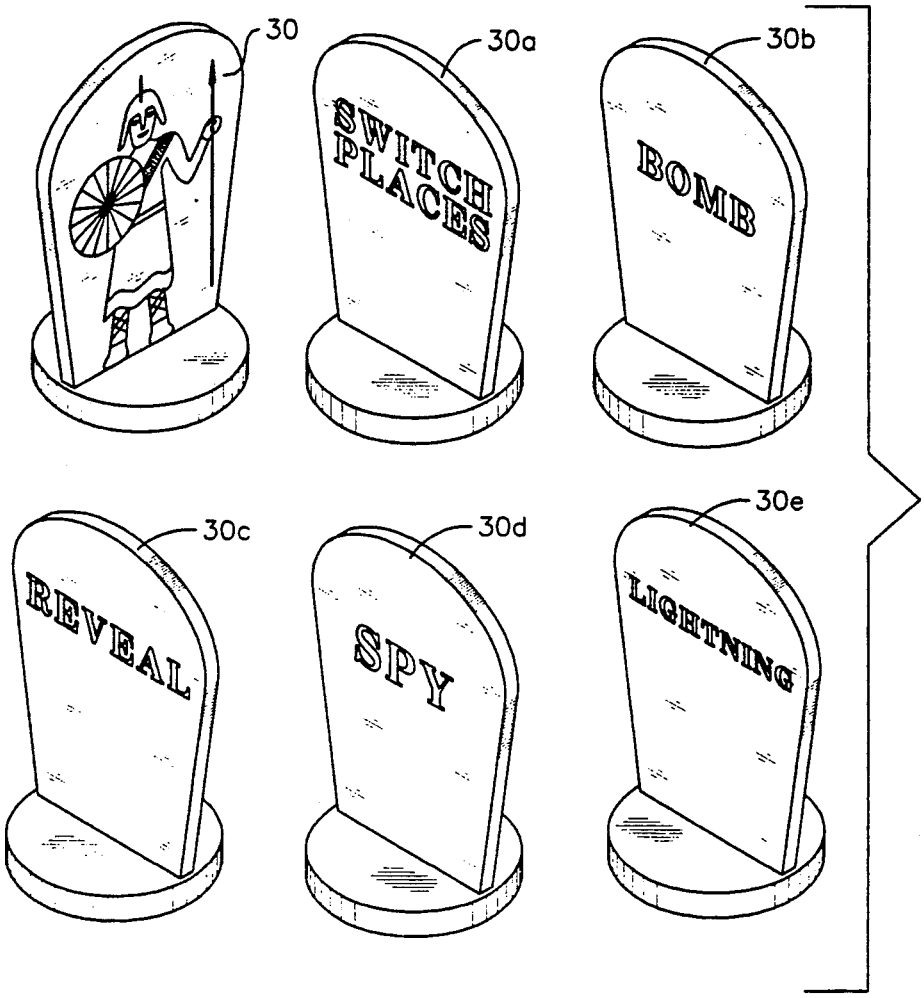
FIG. 2
FIG. 3
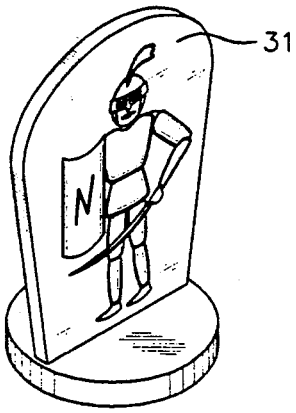
FIG. 4
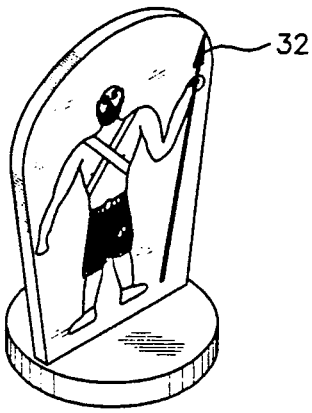
FIG. 5
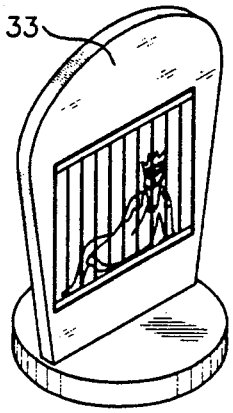

BOARD GAME APPARATUS

BACKGROUND OF THE INVENTION

1. Field of the Invention

The field of invention relates to board game apparatus, and more particularly pertains to a new and improved board game apparatus wherein the same is arranged to direct opposing players to effect recapture of an imprisoned token king.

2. Description of the Prior Art

Board games of various types are utilized throughout the prior art and board games such as checkers and chess have been employed having predetermined movements for various players. In contrast to the prior art, such as exemplified in U.S. Pat. Nos. 5,026,070; 4,226,419; 4,815,745; 4,982,965; and 4,385,764, the instant invention directs a player to attempt the recapture of a captured token king, with various prescribed powers to be designated arbitrarily relative to the individual soldier players. In this respect, the present invention substantially fulfills this need.

SUMMARY OF THE INVENTION

In view of the foregoing disadvantages inherent in the known types of board game apparatus now present in the prior art, the present invention provides a board game apparatus wherein the same directs opposing players to attempt recapture of an initially imprisoned token. As such, the general purpose of the present invention, which will be described subsequently in greater detail, is to provide a new and improved board game apparatus which has all the advantages of the prior art board game apparatus and none of the disadvantages.

To attain this, the present invention provides a board game apparatus arranged to include a game board having an equal predetermined number of rows and columns of squares, wherein opposing groups relative to simulated assemblies of tokens are positioned on opposed end portions of the game board to simulate soldiers, knights, a giant, and a captured king, wherein by elimination of opposing player tokens, a captured king is reclaimed by a moving player from an opposing player.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved board game apparatus which has all the advantages of the prior art board game apparatus and none of the disadvantages.

It is another object of the present invention to provide a new and improved board game apparatus which may be easily and efficiently manufactured and marketed.

It is a further object of the present invention to provide a new and improved board game apparatus which is of a durable and reliable construction.

An even further object of the present invention is to provide a new and improved board game apparatus which is susceptible of a low cost of manufacture with regard to both materials and labor, and which accordingly is then susceptible of low prices of sale to the consuming public, thereby making such board game apparatus economically available to the buying public.

Still yet another object of the present invention is to provide a new and improved board game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2, FIG. 3, FIG. 4, and FIG. 5 are isometric illustrations of various token members utilized by the invention.

DESCRIPTION OF THE PREFERRED EMBODIMENT

Figure 1:
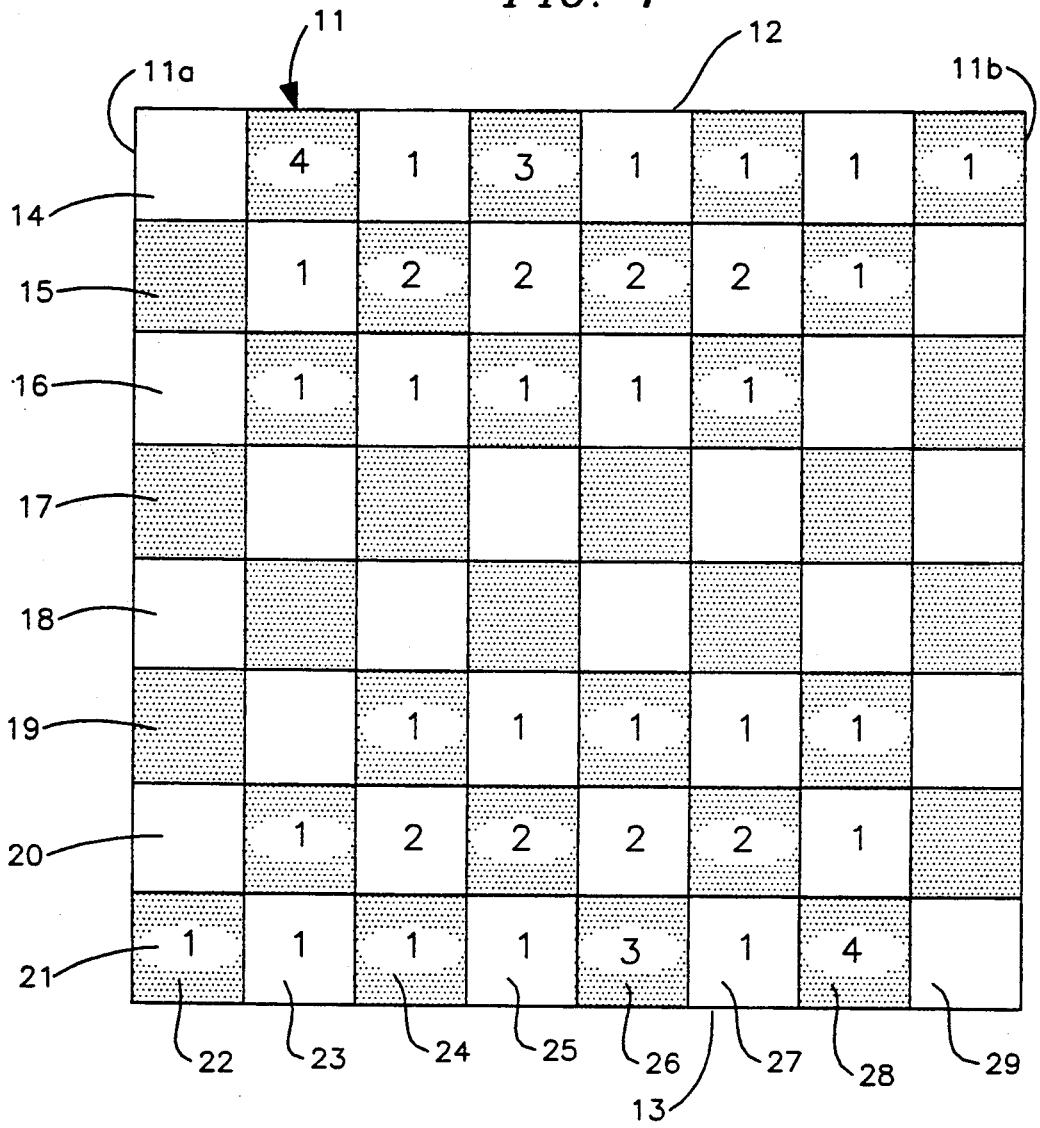
FIG. 1 is an orthographic top view of the game board of the invention.

With reference now to the drawings, and in particular to FIGS. 1 to 9 thereof, a new and improved board game apparatus embodying the principles and concepts of the present invention and generally designated by the reference numerals 11–50 will be described.

More specifically, the game board apparatus of the invention includes a game board 11 having a square matrix of spaces thereon of equal rows and columns, each of a predetermined number. The game board includes a game board first end 12 spaced from and parallel a game board second end 13, with the game board first side 11*a* spaced from and parallel a game board second side 11*b*. The rows of spaces extending from the first end 12 to the second end 13 are defined by the respective first, second, third, fourth, fifth, sixth, seventh, and eighth rows 14–21 respectively. The predetermined number of columns defined by the first through eighth columns 22–29 inclusively are directed from the first side 11*a* to the second side 11*b*. In play of the game, there are provided a predetermined number of tokens for each player of the plurality of players, with one of the plurality of players presenting his team on the first, second, and third rows 14, 15, and 16 at the outset of the game, with a second player of the plurality of players presenting his team of the sixth through eights rows 19–21 respectively. The team of each player includes twelve soldier tokens 30 (see FIG. 2) as well as four knight tokens 31, with one giant representative token 32, and a captured king 33. The captured king is in reality an imprisoned king of the opposing player, wherein an object of the game is to release or free the captured king by providing the game to direct the player such that a moving player positions one of the moving player's tokens into a space occupied by an opponent having the moving player's captured king. There are twelve soldier tokens afforded each player, one such token is afforded "wizardry or wizard" type power, to be described in more detail below, with the remaining ten soldier tokens 30 of each player having powers to include "switch places power" 30*a*, "bomb power" 30*b*, "reveal power" 30*c*, "spy power" 30*d*, and "lightening power" 30*e*. The powers 30*a*, 30*b*, 30*d*, and the "wizard power" effects all of the opposing players except the opponent's giant token 32 and the captured king token 33.

Each opponent takes an individual turn in moving an opposing piece. The game board as indicated in FIG. 1 is representative of an initial positioning of the tokens, with the digit "1" representative of the soldier tokens 30, the digits "2" representative of the knight tokens 31, the digit "3" representative of the giant token 32, and the digit "4" representative of the captured king token 33.

In play of the game, each opponent or player takes individual turns and each token is afforded various movement, wherein the king token 33 may only be moved upon the row initially positioned and only may be positioned one space laterally along that row. The knight token 31 may move vertically, horizontally, or diagonally relative to the game board and the matrix of spaces of the rows and columns. The knight may move as many empty spaces as are available relative to the game board, wherein the giant token 32 may be moved only vertically or horizontally relative to the game board and not diagonally and only one space at a time. The soldier tokens 30 may move vertically, horizontally, or diagonally of one space of the matrix of spaces.

To effect removal of an opposing player's tokens, the following powers are awarded. The captured king token 33 is not permitted any "kill" power. The giant token 32 is awarded killing power upon entering an opponent player's space. The knight may kill an enemy effecting the opponent player's removal of that token by jumping an opposing player's token, and may be permitted jumping up to three opposing player's tokens for that purpose. The knight token 31 may not jump a token on the same team. The soldier tokens 30 are not permitted a killing or removal power but are awarded the special powers as noted above and indicated and exemplified in FIG. 2.

In administering the special powers of the soldier tokens 30, it is typically designated that three of the tokens 30 have the "bomb power" 30*b*, with three of the soldier tokens having the "switch places power" 30*a*, two soldier tokens having the "spy power" 30*d*, one soldier token having the "reveal power" 30*c*, with one soldier token having the "lightening power" 30*e*. Further, one soldier token is designated as a "wizard" to be employed as wizard power as selected by the moving player, but until that time, the wizard power is held in secrecy. To utilize the special powers of the soldier tokens, a soldier token is simply positioned into an opposing player's space of the matrix of spaces. By contrast, the bomb power 30*b* does not require such positioning. In utilization of the bomb power upon revealing such bomb power by a moving player, all opposing tokens in adjacency to the designated soldier token 30 having the bomb power are eliminated or "killed", as well as the player having revealed and utilized the "bomb power" 30*b*. A soldier token 30 utilizing the "switch places power" 30*a* may switch places with any enemy or opposing player's token in direct adjacency to the solder token revealing the "switch places power". When a soldier token reveals the "spy power" 30*d*, the opposing player's token directly in front of him is removed. Upon indicating the "reveal power" 30*c* and reaching an opposing player's row, either the second or seventh row in adjacency to the row contiguous with the ends of the game board, this "reveal power" may be indicated and at this juncture, the opponents soldier token special powers must be indicated to the moving player and shown at the same time so in this manner, the remaining player may know and understand what powers are indicated about him. When a soldier indicates the "lightening power" 30*e*, it may strike opposing soldier tokens in a row and may destroy and effect removal of up to three soldiers in a row of an opposing player's token. The soldier token utilizing the lightening power may strike insofar as there are not any of the opposing players other than the number of tokens up to three soldiers and may strike from any distance. The player utilizing lightening power will remain on the board. Utilization of the wizard power effects casting of a spell upon an opposing player's token in adjacency, whereupon the opposing player's token is incorporated as a member of the moving team's tokens and at that juncture, a friendly token relative to the casting of the wizard's spell. The special powers do not effect the giant token 32.

It should be noted that when a moving player's soldier token 30 reaches a space of an opponents row, i.e. the row adjacent either the first or second end of the game board, that moving player may have repositioned a token having been removed formerly relative to play of the game. The same soldier may not effect a rescue twice and such rescue may be effected twice in the game.

Figure 6:
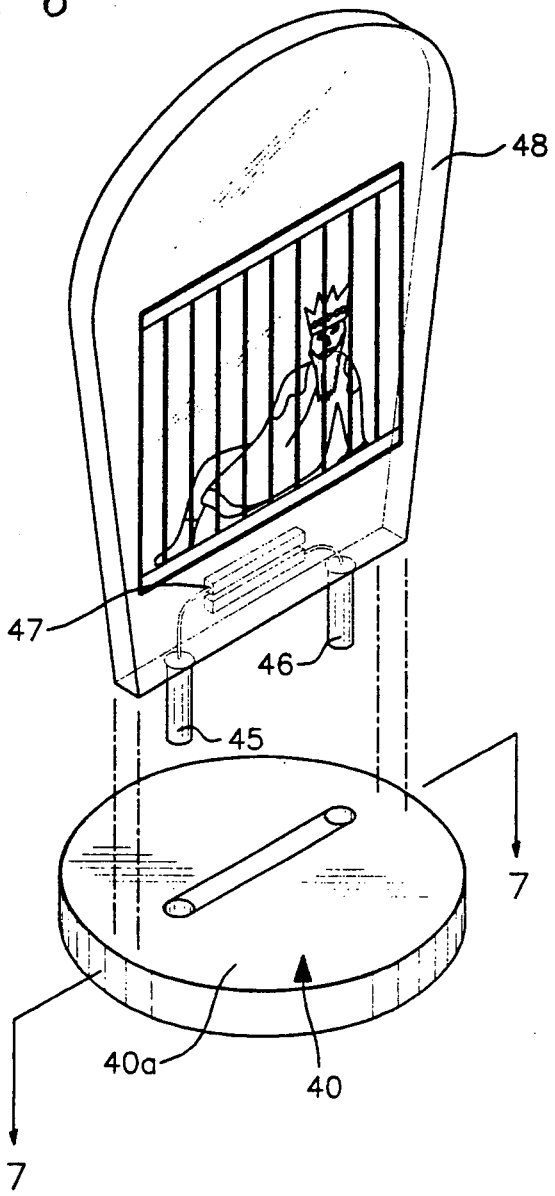
FIG. 6 is an isometric illustration of a modified token member utilized by the invention.
Figure 7:
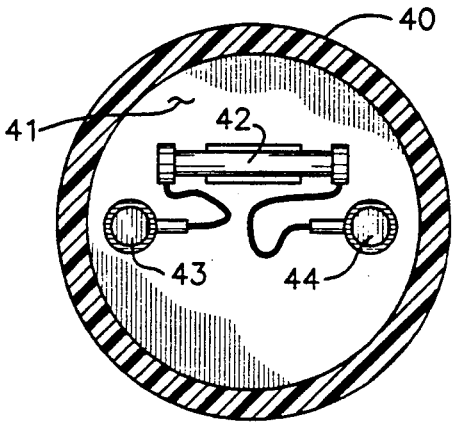
FIG. 7 is an orthographic view, taken along the lines 7—7 of FIG. 6 in the direction indicated by the arrows.
Figure 8:
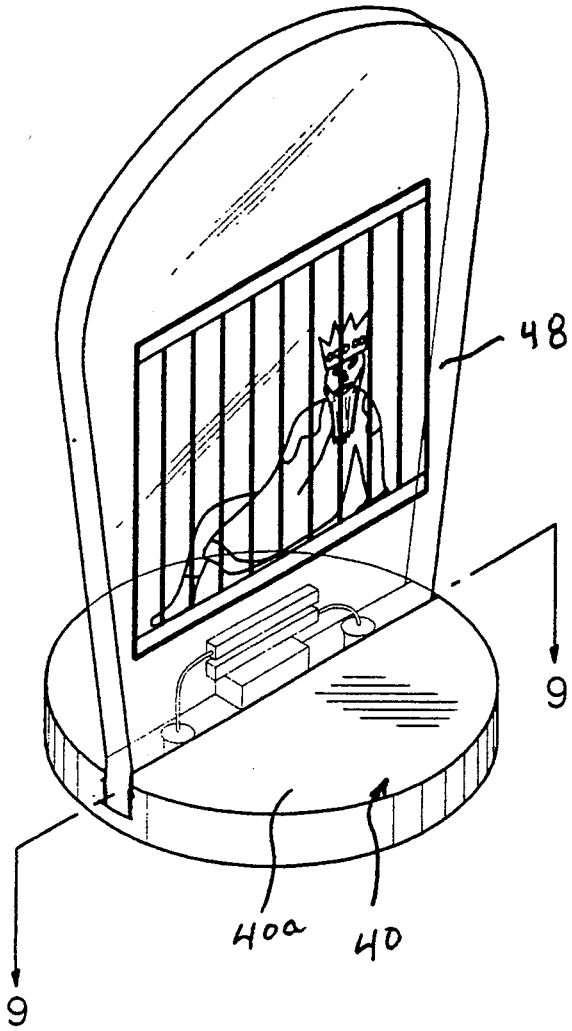
FIG. 8 is an isometric illustration of a further modified token member of the invention.
Figure 9:
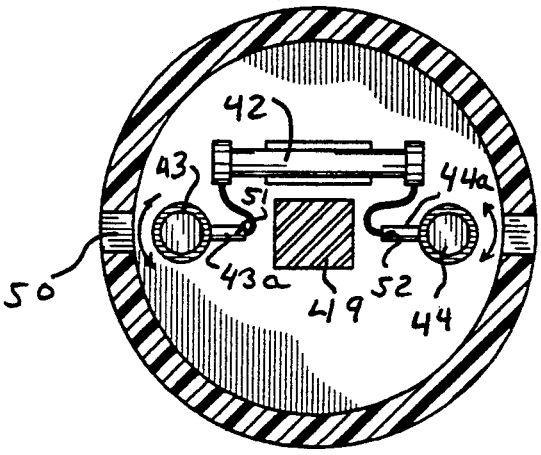
FIG. 9 is an orthographic view, taken along the lines 9—9 of FIG. 8 in the direction indicated by the arrows.
Figure 9A:
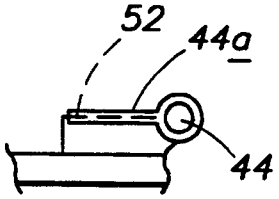
FIG. 9*a* is a pivotal orthographic illustrative view indicating rotation of a socket member, as indicated in FIG. 9.

The token structure, as indicated in the FIGS. 6–9, are tokens that may be employed for illumination purposes, wherein as the captured king token is exemplified, it should be noted that each token may be similarly constructed. It is contemplated that the tokens be utilized for enhanced visibility in use or alternatively, for use by the soldier tokens 30 to indicate their employment of a "special powers" as indicated in FIG. 2. The token structure as indicated in FIG. 6 includes an opaque token base 40 having a base cavity 41, including an illumination bulb 42 therewithin. Respective first and second sockets 43 and 44 are mounted therewithin to receive respective first and second electrodes 45 and 46 in communication with a battery 47, with the electrodes and battery mounted within a translucent token blade 48 orthogonally positioned onto the token base 40. Upon projection of the electrodes 45 and 46 that project below the lower distal end of the blade 48, electrical communication with the illumination bulb 42 is effected for illumination of the bulb and directing such illumination into the blade 48, as the token base top wall 40*a* is transparent between the first and second sockets 43 and 44. The token structure, as indicated in FIG. 8, includes the token base 40 having a slot 50 directed through the top wall 40*a* to receive the token blade 48 therewithin. The first and second sockets 43 and 44 are pivotally mounted about respective first and second socket axles 51 and 52 that are in turn mounted through respective first and second pivot tubes 43*a* and 44*a* orthogonally secured to lower ends of the respective first and second sockets 43 and 44. Upon downward pivotment of the first and sockets 43 and 44, the first and second electrodes 45 and 46 may not be inserted into the respective first and second sockets 43 and 44 and thereby selective illumination of the token blade 48 is effected. In this manner, selective illumination of the token is effected to indicate utilization of one of the special powers such as indicated in FIG. 2. It should be noted, as illustrated in FIG. 9, that the base cavity includes a ferrous magnet mounted therewithin between the first socket and the second socket, and the battery 47 is configured to include a ferrous casing positioned in adjacency to the lower distal end of the token blade for magnetic adherence to the magnet 49 to enhance securement of the token blade relative to the token base in assembled configuration.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

As an alternative, for example, two switch place soldiers and three spy soldiers may be utilized. One of the twelve soldiers (as a blank or previously unempowered token) may be empowered with the knight's powers to "kill" opponent tokens.

What is claimed as being new and desired to be protected by LETTERS PATENT of the United States is as follows:

1. A board game apparatus, comprising, a game board, the game board having a matrix of spaces, wherein the game board includes a game board first end spaced from and parallel to a game board second end, and a game board first side spaced from and parallel to a game board second side, with a predetermined number of rows of said spaces directed between the first end and the second end, and a plurality of columns equal to said predetermined number directed between the first side and second side in a parallel relationship, wherein the columns orthogonally intersect the rows, and the first team of tokens positioned adjacent the game board first end, and a second team of tokens positioned adjacent the second end, the first team of tokens having soldier tokens, knight tokens, a giant token, and a captured king token, with the second team of tokens having a second team plurality of soldier tokens, second team knight tokens, a second team giant token, and a second team captured king token, with the soldier tokens movable orthogonally between the first end and the second end, and orthogonally between the first side and the second side, and diagonally relative to the first end and the second end and the first side and the second side relative to the spaces, and the knight token movable orthogonally relative to the first side and the second side and orthogonally relative to the first end and the second end of the game board and diagonally relative to the first side and the second side and the first end and the second end relative to the spaces, and the captured king token maintained in one of said rows adjacent the first end of the first team, and the second team having the second team captured king token positioned in one of said rows adjacent the second end, and each of the tokens includes a token base, the token base having a token blade, wherein the token blade is translucent and the token base includes a token base cavity, the token base cavity having an illumination bulb mounted therewithin, and a first socket and a second socket in electrical communication with the illumination bulb, the first socket mounted to a first tube, the second socket mounted to a second tube, with the first tube having a first axle mounted through the first tube permitting pivoting of the first socket, and the second socket axle mounted through the second tube permitting pivoting of the second socket, and the token blade having a lower distal end received within the token base, and the lower distal end having a first electrode and a second electrode, and a battery mounted within the token blade between the first electrode and the second electrode, wherein the first electrode and the second electrode are received within a respective first socket and second socket, wherein the first socket and the second socket are coaxially aligned with the first electrode and the second electrode respectively in the first position permitting illumination of the illumination bulb, with the first socket and the second socket pivoted and displaced relative to the first electrode and the second electrode in a second position effecting discontinuance of communication of the battery with the illumination bulb.

2. An apparatus as set forth in claim 1 wherein the token base includes a slot and the blade is received within the slot, and the battery having a ferrous metallic casing positioned in adjacency to the lower distal end and the token base cavity having a ferrous magnet mounted therewithin in magnetic adherence to the casing.

* * * * *